US007160117B2

(12) United States Patent
Ngo

(10) Patent No.: US 7,160,117 B2
(45) Date of Patent: Jan. 9, 2007

(54) HIGH SPEED, HIGH SIGNAL INTEGRITY ELECTRICAL CONNECTORS

(75) Inventor: Hung Viet Ngo, Harrisburg, PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 10/918,169

(22) Filed: Aug. 13, 2004

(65) Prior Publication Data

US 2006/0035531 A1 Feb. 16, 2006

(51) Int. Cl.
*H01R 12/00* (2006.01)

(52) U.S. Cl. ..... 439/76.1

(58) Field of Classification Search ..... 439/76.1, 439/579, 580, 701, 704, 715–717, 724, 680, 439/681, 607, 610, 709
See application file for complete search history.

(56) References Cited

U.S. PATENT DOCUMENTS

| | | | | |
|---|---|---|---|---|
| 3,286,220 | A | 11/1966 | Marley et al. | 439/680 |
| 3,538,486 | A | 11/1970 | Shlesinger, Jr. | 439/268 |
| 3,669,054 | A | 6/1972 | Desso et al. | 113/119 |
| 3,748,633 | A | 7/1973 | Lundergan | 339/217 S |
| 4,076,362 | A | 2/1978 | Ichimura | 339/75 |
| 4,159,861 | A | 7/1979 | Anhalt | 339/75 |
| 4,260,212 | A | 4/1981 | Ritchie et al. | 339/97 R |
| 4,288,139 | A | 9/1981 | Cobaugh et al. | 339/74 R |
| 4,383,724 | A | 5/1983 | Verhoeven | 439/510 |
| 4,402,563 | A | 9/1983 | Sinclair | 339/75 |
| 4,560,222 | A | 12/1985 | Dambach | 339/75 |
| 4,717,360 | A | 1/1988 | Czaja | 439/710 |
| 4,776,803 | A | 10/1988 | Pretchel et al. | 439/59 |
| 4,815,987 | A | 3/1989 | Kawano et al. | 439/263 |
| 4,867,713 | A | 9/1989 | Ozu et al. | 439/833 |
| 4,900,274 | A * | 2/1990 | Dorleans et al. | 439/680 |
| 4,907,990 | A | 3/1990 | Bertho et al. | 439/851 |
| 4,973,271 | A | 11/1990 | Ishizuka et al. | 439/839 |
| 5,077,893 | A | 1/1992 | Mosquera et al. | 29/882 |
| 5,174,770 | A | 12/1992 | Sasaki et al. | 439/108 |
| 5,238,414 | A | 8/1993 | Yaegashi et al. | 439/108 |
| 5,254,012 | A | 10/1993 | Wang | 439/263 |
| 5,274,918 | A | 1/1994 | Reed | 29/882 |
| 5,302,135 | A | 4/1994 | Lee | 439/263 |
| 5,431,578 | A | 7/1995 | Wayne | 439/259 |
| 5,475,922 | A | 12/1995 | Tamura et al. | 29/881 |
| 5,558,542 | A | 9/1996 | O'Sullivan et al. | 439/682 |

(Continued)

FOREIGN PATENT DOCUMENTS

EP 0 273 683 A2 7/1988

(Continued)

*Primary Examiner*—Ross Gushi
(74) *Attorney, Agent, or Firm*—Woodcock Washburn LLP

(57) ABSTRACT

An electrical connector may include a connector housing and a terminal tray. The terminal tray may include a tray body having a latch extending therefrom. The connector housing may define a latch receiving window. The latch and latch receiving window may be disposed such that the latch engages the latch receiving window only when the terminal tray is received in the housing in a preferred orientation. The terminal tray may include an electrically conductive contact having a board receiving end adapted to receive a printed circuit board and to exert sufficient pressure on the printed circuit board to retain the printed circuit board between the contact and the tray body. The connector may also include a plurality of cables bundled by a band, such as double-sided tape, such that respective portions of the cables are restrained from movement relative to one another.

22 Claims, 15 Drawing Sheets

U.S. PATENT DOCUMENTS

| | | | | |
|---|---|---|---|---|
| 5,590,463 | A | 1/1997 | Feldman et al. | 29/844 |
| 5,609,502 | A | 3/1997 | Thumma | 439/747 |
| 5,730,609 | A | 3/1998 | Harwath | 439/108 |
| 5,741,144 | A | 4/1998 | Elco et al. | 439/101 |
| 5,741,161 | A | 4/1998 | Cahaly et al. | 439/709 |
| 5,795,191 | A | 8/1998 | Preputnick et al. | 439/608 |
| 5,817,973 | A | 10/1998 | Elco | 174/32 |
| 5,908,333 | A | 6/1999 | Perino et al. | 439/631 |
| 5,940,962 | A * | 8/1999 | Shima et al. | 29/825 |
| 5,961,355 | A | 10/1999 | Morlion et al. | 439/686 |
| 5,971,817 | A | 10/1999 | Longueville | 439/857 |
| 5,980,321 | A | 11/1999 | Cohen et al. | 439/608 |
| 5,993,259 | A | 11/1999 | Stokoe et al. | 439/608 |
| 6,036,543 | A * | 3/2000 | Panis et al. | 439/607 |
| 6,050,862 | A | 4/2000 | Ishii | 439/843 |
| 6,068,520 | A | 5/2000 | Winings et al. | 439/676 |
| 6,123,554 | A | 9/2000 | Ortega et al. | 439/79 |
| 6,125,535 | A | 10/2000 | Chiou et al. | 29/883 |
| 6,139,336 | A | 10/2000 | Olson | 439/83 |
| 6,146,157 | A | 11/2000 | Lenoir et al. | 439/101 |
| 6,146,203 | A | 11/2000 | Elco et al. | 439/609 |
| 6,190,213 | B1 | 2/2001 | Reichart et al. | 439/736 |
| 6,212,755 | B1 | 4/2001 | Shimada et al. | 29/527.1 |
| 6,219,913 | B1 | 4/2001 | Uchiyama | 29/883 |
| 6,220,896 | B1 | 4/2001 | Bertoncini et al. | 439/608 |
| 6,269,539 | B1 | 8/2001 | Takahashi et al. | 29/883 |
| 6,276,943 | B1 * | 8/2001 | Boutros et al. | 439/76.1 |
| 6,293,827 | B1 | 9/2001 | Stokoe et al. | 439/608 |
| 6,319,075 | B1 | 11/2001 | Clark et al. | 439/825 |
| 6,328,602 | B1 | 12/2001 | Yamasaki et al. | 439/608 |
| 6,347,952 | B1 | 2/2002 | Hasegawa et al. | 439/608 |
| 6,350,134 | B1 | 2/2002 | Fogg et al. | 439/79 |
| 6,363,607 | B1 | 4/2002 | Chen et al. | 29/883 |
| 6,371,773 | B1 | 4/2002 | Crofoot et al. | 439/79 |
| 6,379,188 | B1 | 4/2002 | Cohen et al. | 439/608 |
| 6,409,543 | B1 | 6/2002 | Astbury, Jr. et al. | 439/608 |
| 6,431,914 | B1 | 8/2002 | Billman | 439/608 |
| 6,435,914 | B1 | 8/2002 | Billman | 439/608 |
| 6,461,202 | B1 | 10/2002 | Kline | 439/701 |
| 6,471,548 | B1 | 10/2002 | Bertoncini et al. | 439/608 |
| 6,506,081 | B1 | 1/2003 | Blanchfield et al. | 439/682 |
| 6,537,111 | B1 | 3/2003 | Brammer et al. | 439/857 |
| 6,554,647 | B1 | 4/2003 | Cohen et al. | 439/607 |
| 6,565,366 | B1 * | 5/2003 | Wu | 439/76.1 |
| 6,572,410 | B1 | 6/2003 | Volstorf et al. | 439/608 |
| 6,652,318 | B1 | 11/2003 | Winings et al. | 439/608 |
| 6,663,428 | B1 * | 12/2003 | Wu | 439/608 |
| 6,674,004 | B1 * | 1/2004 | Ito et al. | 174/68.3 |
| 6,677,848 | B1 * | 1/2004 | Emery | 336/206 |
| 6,692,272 | B1 | 2/2004 | Lemke et al. | 439/108 |
| 6,776,658 | B1 | 8/2004 | Tang | 439/607 |
| 2002/0143894 | A1 | 10/2002 | Takayama | 709/217 |
| 2003/0220021 | A1 | 11/2003 | Whiteman, Jr. et al. | 439/608 |

FOREIGN PATENT DOCUMENTS

| | | |
|---|---|---|
| JP | 06-236788 | 8/1994 |
| JP | 07-114958 | 5/1995 |
| JP | 2000-003743 | 1/2000 |
| JP | 2000-003744 | 1/2000 |
| JP | 2000-003745 | 1/2000 |
| JP | 2000-003746 | 1/2000 |
| WO | WO 01/29931 A1 | 4/2001 |
| WO | WO 01/39332 A1 | 5/2001 |

* cited by examiner

HIGH SPEED, HIGH SIGNAL INTEGRITY ELECTRICAL CONNECTORS

CROSS-REFERENCE TO RELATED APPLICATIONS

This application is related to U.S. patent application Ser. No. 10/294,966, filed Nov. 14, 2002, which is a continuation-in-part of U.S. patent application Ser. No. 09/990,794, filed Nov. 14, 2001, now U.S. Pat. No. 6,692,272, and Ser. No. 10/155,786, filed May 24, 2002, now U.S. Pat. No. 6,652,318. The contents of each of the above-referenced U.S. patents and patent applications is herein incorporated by reference in its entirety.

FIELD OF THE INVENTION

Generally, the invention relates to the field of electrical connectors. More particularly, the invention relates to input/output ("I/O") connectors that provide impedance-controlled, high-speed, low-interference communications between a computer, for example, and an external device, such as a printer, scanner, or the like.

BACKGROUND OF THE INVENTION

Input/output (I/O) cable connectors may be used for electrically connecting a computer with an external component, such as a printer, scanner, or the like.

Some such connectors include one or more terminal trays that include respective linear arrays of electrical contacts. The electrical contacts may be signal contacts, ground contacts, or a combination of signal and ground contacts. Typically, a plurality of such terminal trays are arranged relative to one another such that a two-dimensional contact array is formed. In such an arrangement, it may be desirable to orient certain of the terminal trays in certain ways. Failure to orient one or more trays in the desired way may result in the manufacture of a faulty connector. It would be desirable, therefore, if terminal trays were available that minimized or eliminated the possibility of assembling the connector with a terminal tray in an undesired orientation.

Some such connectors include a printed circuit board (PCB), such as an equalizer card, for example. Typically, each electrical contact is soldered to a corresponding contact pad on the PCB. Such soldering may be labor intensive and expensive. It would be desirable, therefore, if connectors were available wherein the PCB could be retained within the connector without the need for soldering the PCB to the contacts.

Some such connectors include interfaces to one or more cables. Such cables typically include an electrical conductor encapsulated in a polymer coating. It is often desirable to bundle a plurality of such cables together, and to bundle them together in a manner that limits stress on the cables.

SUMMARY OF THE INVENTION

An electrical connector according to the invention may include a connector housing and a terminal tray received within an interior portion of the connector defined by the housing. The terminal tray may include a tray body made of an electrically insulating material. The tray body may have a latch extending therefrom, and the connector housing may define a latch receiving window. The latch and latch receiving window may be disposed such that the latch engages the latch receiving window only when the terminal tray is received in the housing in a preferred orientation.

The terminal tray may include an electrically conductive contact having a connector mating end that extends beyond an end of the tray body and a board receiving end opposite the connector mating end. The board receiving end of the contact may be adapted to receive a printed circuit board and to exert sufficient pressure on the printed circuit board to retain the printed circuit board between the contact and the tray body.

The connector may also include first and second cables extending through respective cable housings. The cables may be bundled by a band such that respective portions of the cables are restrained from movement relative to one another. The band may include a double-sided tape, which may be adhered between a first side of the first cable and a first side of the second cable, and may wrap around the cable housings.

DETAILED DESCRIPTION OF ILLUSTRATIVE EMBODIMENTS

Figure 1:
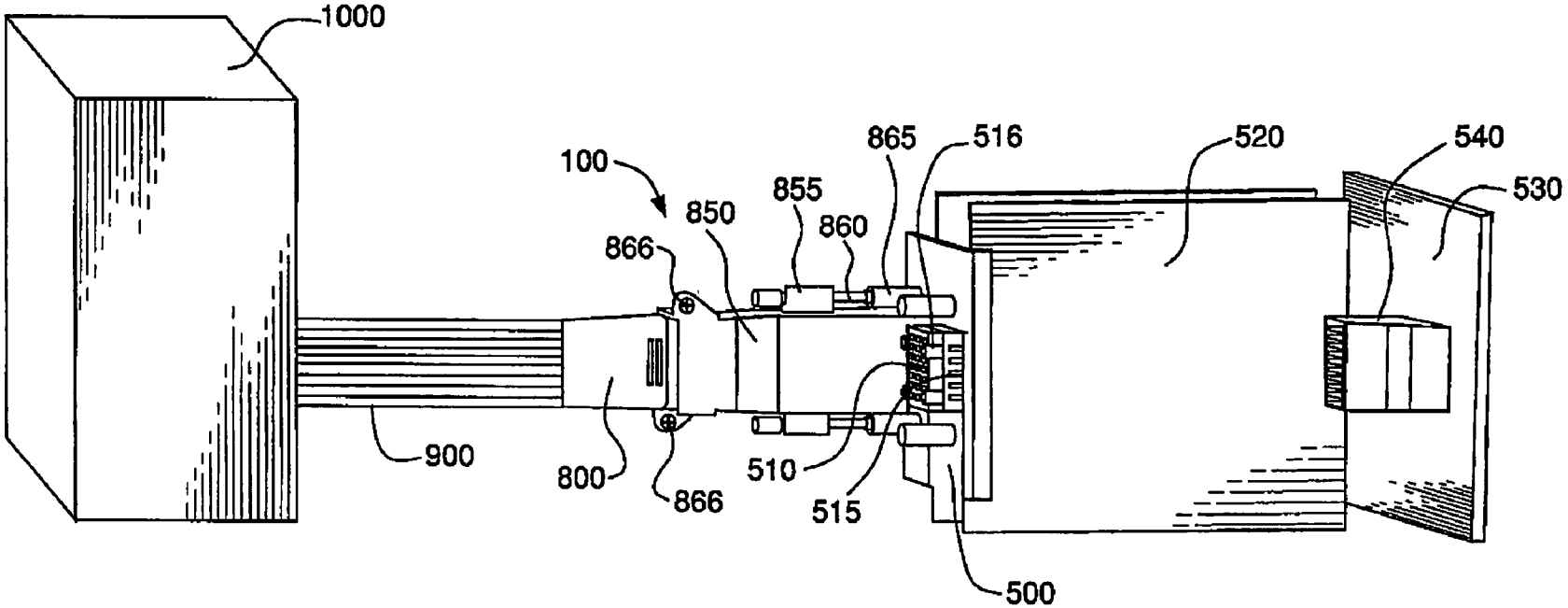
FIG. 1 depicts an example embodiment of a connector according to the invention.

FIG. 1 depicts an example embodiment of a connector 100 in accordance with the invention. Connector 100 may enable a computer or other device to communicate with an external component 1000, such as such as a printer or scanner, for example. Connector 100 may be connected to a receptacle 510. Receptacle 510 may be mounted on a face plate 500 of a computer, for example, and may be electrically connected to a daughter card 520, for example, internal to the computer. The daughter card 520 may be connected to a mother board 530 internal to the computer by a high speed connector 540. High speed connector 540 may facilitate the propagation of signals at speeds of approximately 10 Gb/s with high signal integrity. Examples of such a high speed connector are disclosed and claimed in, for example, U.S. patent application Ser. No. 10/294,966, entitled "Cross Talk Reduction And Impedance-Matching For High Speed Electrical Connectors," the disclosure of which is incorporated herein by reference in its entirety.

Connector 100 may have a connector body 850. Connector body 850 may be cast or formed of two halves, which may be identical and may be connected to one another via one or more assembly screws 866. Connector body 850 may have a mount screw holder 855 and alignment screws 860 aligned with a screw post 865 of face plate 500. Alignment screw 860 may protrude beyond an end of connector 100 such that alignment screw 860 may be properly aligned with screw post 865 prior to connecting connector 100 to receptacle 510. In this way, contacts (not shown in FIG. 1) within connector 100 may not be damaged during the connecting process.

Receptacle 510 may also have a ground band 515 associated with an electrical ground such that when connector 100 is connected to receptacle 510, connector body 850 electrically connects with ground band 515. Receptacle 510 may include alignment features 516 to facilitate alignment of connector 100 during the connecting process.

Connector 100 may also include a boot 800 that covers and protects a cable bundle 900. Cable bundle 900 may connect to external component 1000.

Figure 2B:
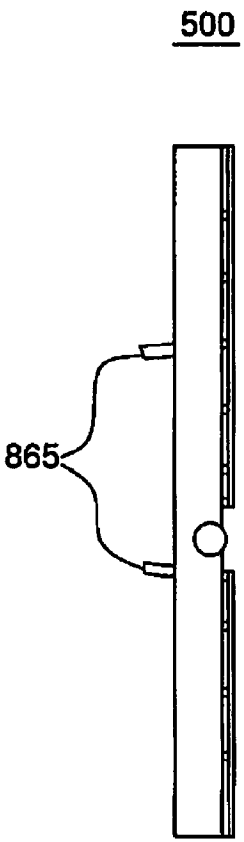
FIGS. 2A and 2B depict cross-sectional front and side views, respectively, of a face-plate.
Figure 2A:
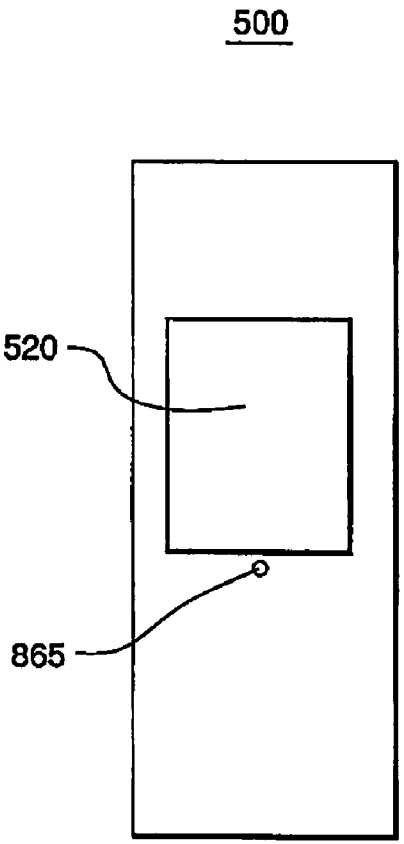

FIG. 2A depicts a cross-sectional front view and FIG. 2B depicts a cross-sectional side view of an example embodiment of a face plate 500. Face plate 500 may facilitate the physical and electrical connection of connector 100 to a device such as a computer. Face plate 500 may have a cut-out 520 of an appropriate size for mounting a receptacle, such as receptacle 510 described in connection with FIG. 1. Faceplate 500 also may have one or more screw posts 865 to receive mounting screws 860 of connector 100. Face plate 500 may be constructed of plastic or other suitable material.

Figure 3:
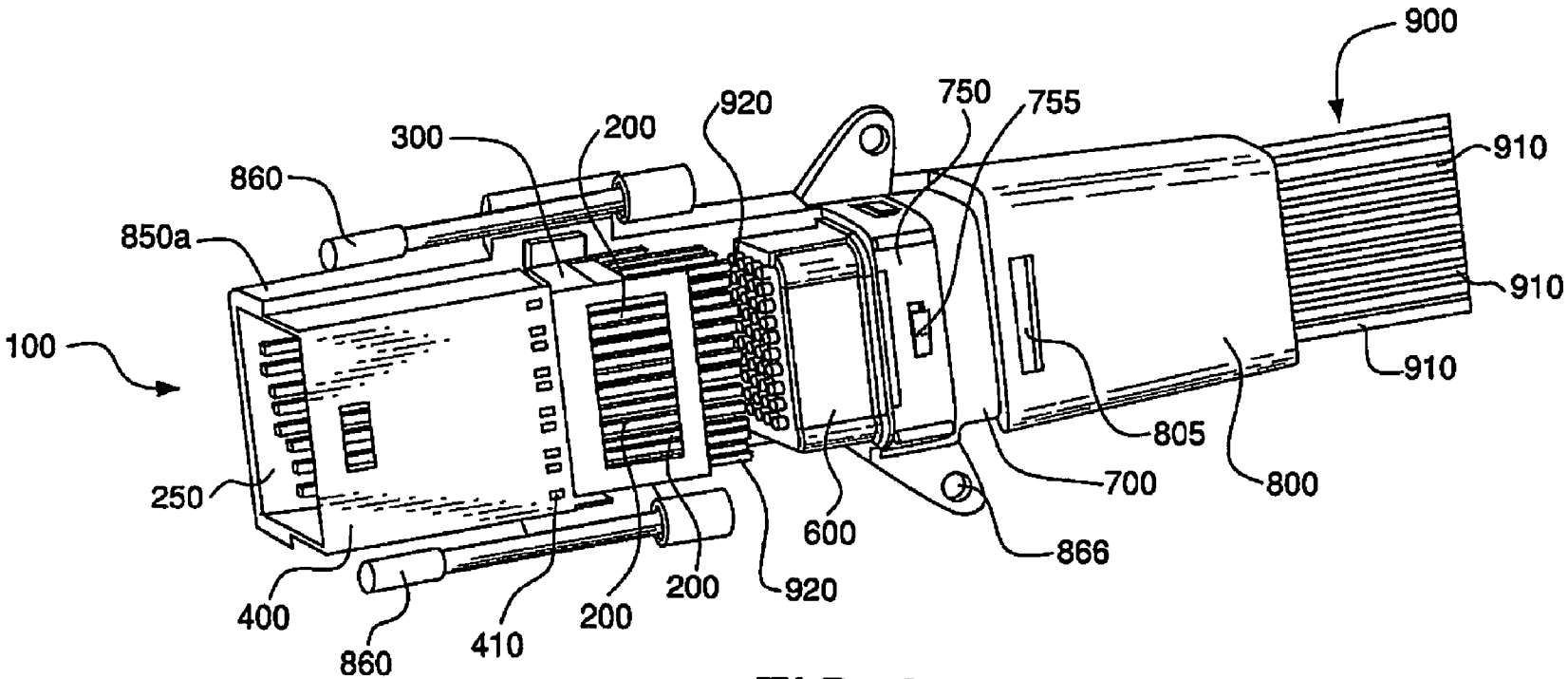
FIG. 3 depicts an example embodiment of a connector according to the invention.

FIG. 3 depicts a partial cut-away view of an example embodiment of a connector 100 in accordance with the invention. For clarity, connector 100 is shown in FIG. 3 with only one half 850*a* of the connector body. Connector 100 may include one or more electrical contacts 250. Contacts 250 may be molded as part of or attached to terminal trays 200. Printed circuit boards (PCBs) 300 may also be attached to terminal trays 200. Contacts 250 may be electrically connected to PCBs 300. Cable wires 920 may also be electrically connected to PCBs 300. In this way PCBs 300 may electrically connect contacts 250 to cable wires 920. In an alternative embodiment, respective contacts 250 and cable wires 920 may be electrically connected directly, without use of PCBs 300.

Terminal trays 200 may be at least partially housed in an interior of a connector header 400. Terminal trays 200 may be secured in connector header 400 through use of polarized latch windows 410. Connector body 850 may have a mount screw 860 for mounting connector 100 to receptacle 510.

Connector 100 may also include cable wires 920 located within cables 910. Cables 910 may be held in a cable bundle 900 in part by a crimp sleeve 750 and crimp sleeve support 700. A braid 600 may electrically connect a braid shield (not shown in FIG. 3) of cables 910 to crimp sleeve 750. Crimp sleeve 750 may be deformed after placement on crimp sleeve support 700 to aid in holding cable bundle 900 and preventing cables 910 from relative movement within connector body 850 when cable bundle 900 located outside of connector body 850 is moved. Crimp sleeve 750 also may have a ground contact 755 that electrically connects with connector body 850 when the two halves 850*a* of connector body 850 are attached to connector 100. The two halves 850*a* of connector body 850 may be identical and may be connected through use of an assembly screw 866. Connector 100 may also include a boot 800 that attaches to crimp sleeve support 700 and protects cable bundle 900 in the vicinity of connector body 850.

Figure 4B:
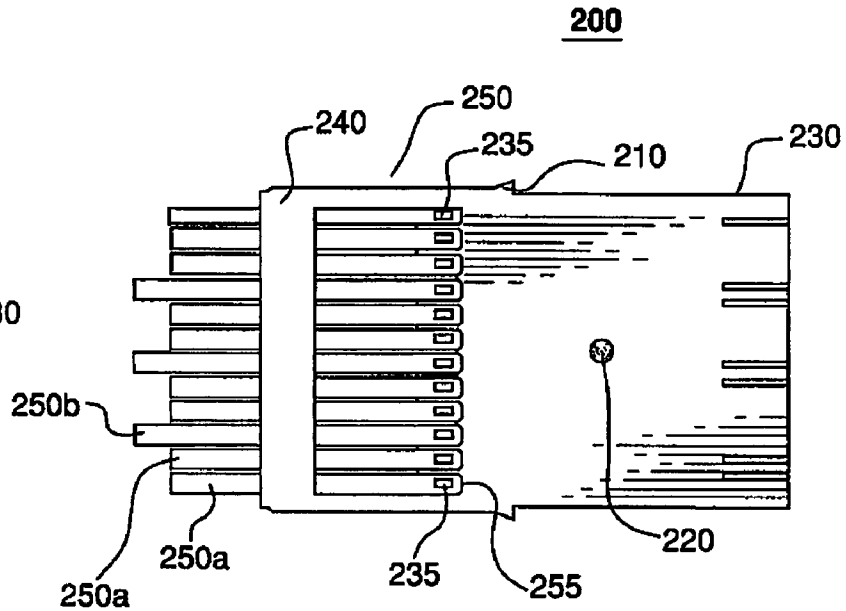
FIGS. 4A and 4B depict perspective views of example embodiments of terminal trays.
Figure 4A:
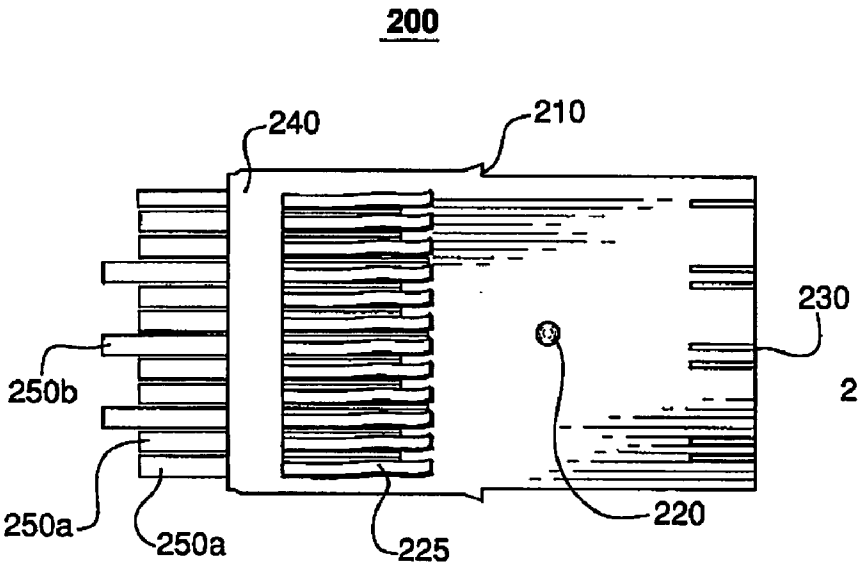

FIGS. 4A and 4B depict perspective views of example embodiments of terminal trays 200. A terminal tray 200 may include one or more electrical contacts 250. Contacts 250 may be molded as part of terminal tray 200 or may be attached to terminal tray 200. Contacts 250 may be signal contacts 250*a* or ground contacts 250*b*. Signal contacts 250*a* may function as differential signal pairs, or may be single-ended signal conductors. FIGS. 4A and 4B show ground contacts 250*b* that are longer than signal contacts 250*a* so that the ground contacts 250*b* electrically connect with receptacle 510 before signal contacts 250*a* during the connecting process. It should be noted, however, that ground contacts 250*b* may be of a length equal to or shorter than signal contacts 250*a*. Terminal tray 200 may include latches 210. Latches 210 may correspond to polarized latch windows 410 of connector header 400.

Terminal tray 200 may also include a press-fit pin 220 corresponding to a press fit hole on PCB 300 (not shown in FIGS. 4A and 4B) to facilitate attaching PCB 300 to terminal tray 200 in a desired location. Terminal tray 200 may include one or more cable dividers 230. Cable dividers 230 may be molded as part of terminal tray 200 and may aid in maintaining the alignment of cables 910. Terminal tray 200 may be constructed of plastic or similar material.

FIG. 4A depicts a first embodiment of contacts 250, wherein an end 225 of each contact 250 may be bent into a "scoop" or "U" shape. The "scoop" or "U" shape enables PCB 300 to slide underneath contacts 250 and enables contacts 250 to electrically connect to PCB 300 from downward pressure exerted by contacts 250 on PCB 300. Contacts 250 may be resilient and, accordingly, exert a spring force on the PCB. The amount of pressure contacts 250 exert on PCB 300 may be increased by shortening the distance contacts 250 extend beyond bar 240, which acts as a fulcrum. Likewise, the amount of pressure contacts 250 exert on PCB 300 may be decreased by lengthening the distance contacts 250 extend beyond bar 240. In this way, soldering contacts 250 to PCB 300 is not necessary. Additionally, unsoldering contacts from PCB 300 to perform maintenance on connector 100 is also not necessary. With the use of the embodiment of FIG. 4A, PCB 300 and terminal tray may be disconnected by pulling PCB 300 away from contacts 250.

FIG. 4B depicts an alternative embodiment of contacts 250, wherein each contact 250 has a solder slot 235 near the end 225 of contacts 250 that extend over terminal tray 200. Solder slots 235 may facilitate the soldering of contacts 250 to PCB 300.

Figure 5:
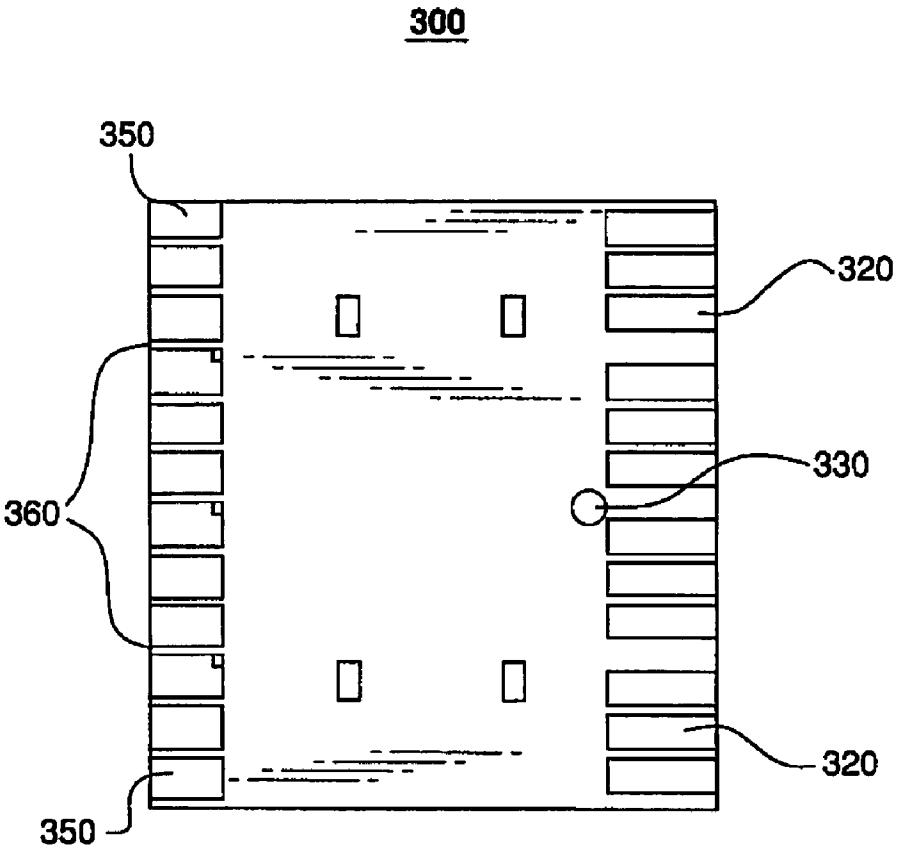
FIG. 5 depicts an example embodiment of a printed circuit board.

FIG. 5 depicts an example embodiment of a PCB 300. PCB 300 may be, for example, an equalizer card that may equalize signal propagation time of signals through connector 100. It should be understood, however, that PCB 300 may be used for other purposes as well. PCB 300 may include terminal contact pads 350 to electrically connect PCB 300 to electrical contacts 250. Such connection may be by soldering or by contact pressure as described above with regard to FIGS. 4A and 4B. Additionally, any other suitable means for electrically connecting contact pads 350 to contacts 250 may be used. PCB 300 may also include cable wire contact pads 320 for electrically connecting PCB 300 with cable wires 920. PCB 300 may include press-fit hole 330 to facilitate physical connection of PCB 300 to terminal tray 200 by aligning press fit hole 330 with press fit pin 220 on terminal tray 200.

PCB 300 may also include one or more assembly control slots 360. Assembly control slots 360 may be slots in PCB 300 that align with corresponding location keys (not shown) in terminal tray 200. Assembly control slots 360 may facilitate, along with press-fit hole 330, attachment of PCB 300 to terminal tray 200 in a desired location.

Figure 6B:
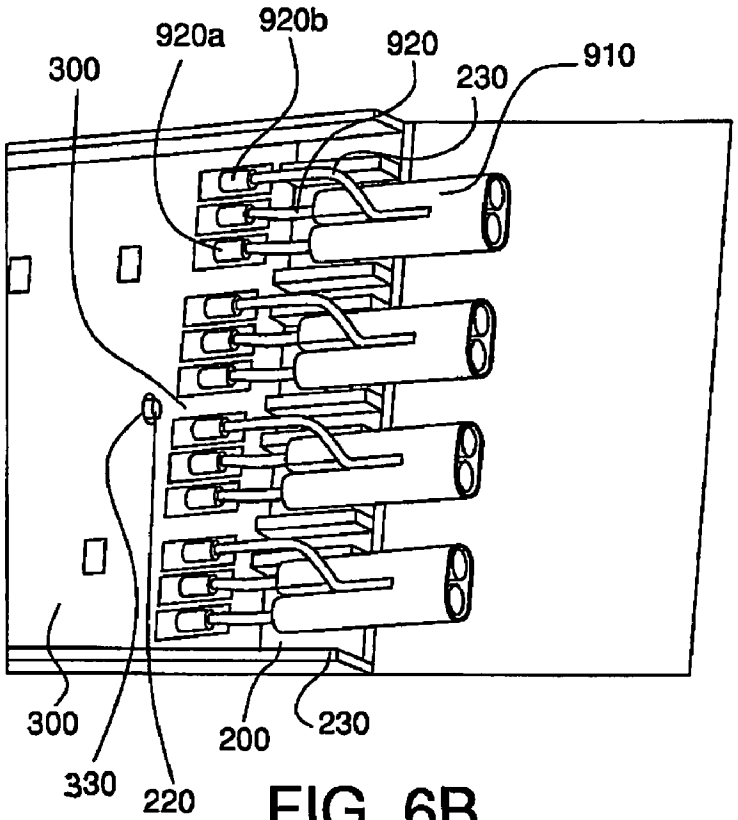
FIGS. 6A and 6B depict exploded, cut-away views of example embodiments of a printed circuit board with, respectively, a terminal tray and cables.
Figure 6A:
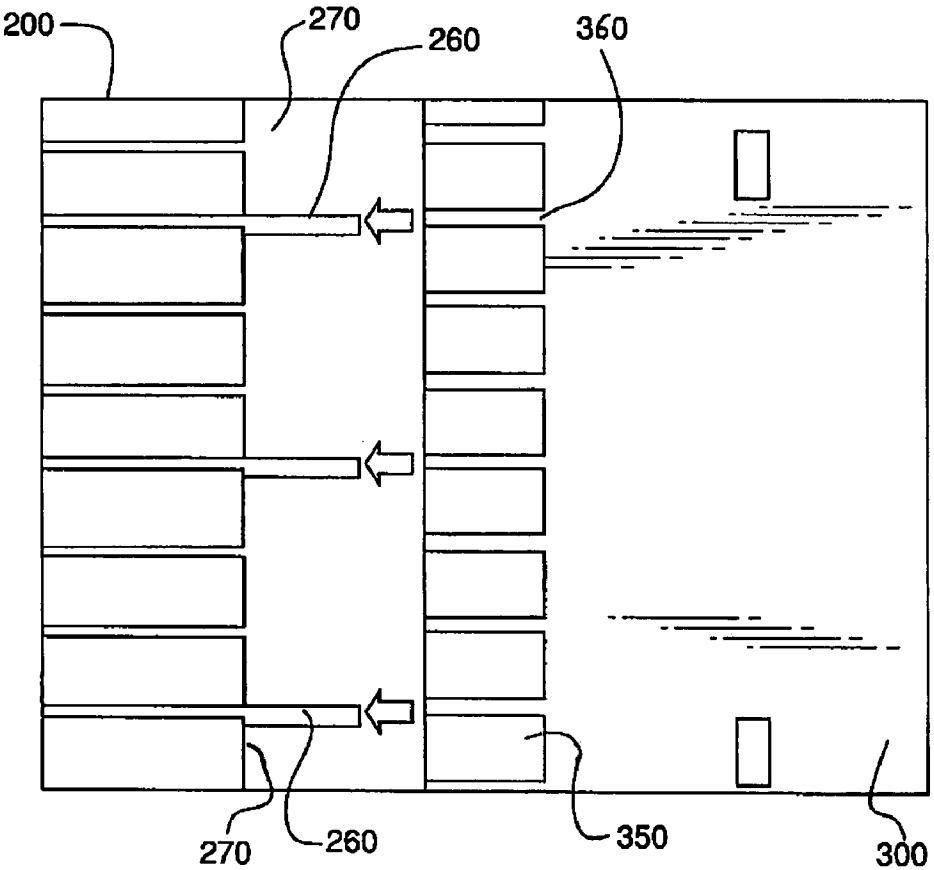

FIGS. 6A and 6B depict exploded, cut-away views of a PCB 300, respectively, with terminal tray 200 without contacts 250, and with cables 210 and cable wires 220. In FIG. 6A, location keys 260 on terminal tray 200 may align with assembly control slots 350 on PCB 300 to facilitate attaching PCB 300 in a proper location with a proper alignment to terminal tray 200. Additionally, ribs 270 on terminal tray 200 may facilitate positioning PCB 300 on terminal tray 200 by providing a positive stop when sliding PCB 300 under contacts 250.

FIG. 6B depicts an example embodiment of cable dividers 230 on terminal tray 200 with cables 910. Also, PCB 300 is depicted with cable wires 920 connected. Cable dividers 230 may aid in maintaining proper alignment and spacing of cables 910. As shown in FIG. 6B, each of cables 910 comprises two differential signal cable wires 920*a* and a ground cable wire 920*b*. It should be recognized, however, that cables 910 may carry single-ended signals as well. FIG. 6B also depicts an example embodiment of press fit pin 220 of terminal tray 200 through press fit hole 330 of PCB 300.

Figure 7B:
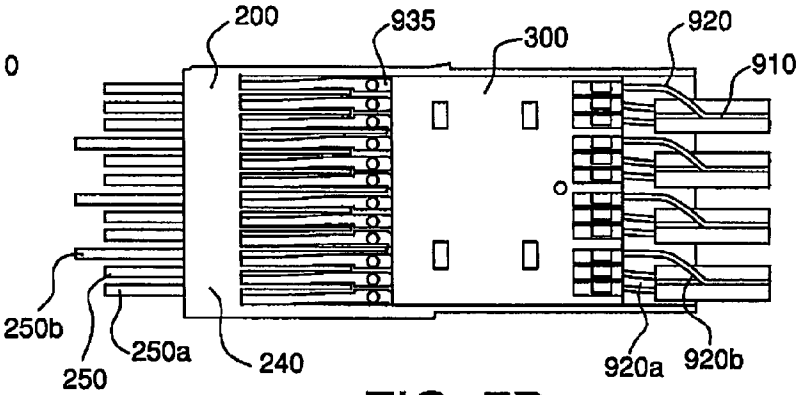
FIGS. 7A–7C depict an example embodiments of terminal trays connected to cables.
Figure 7A:
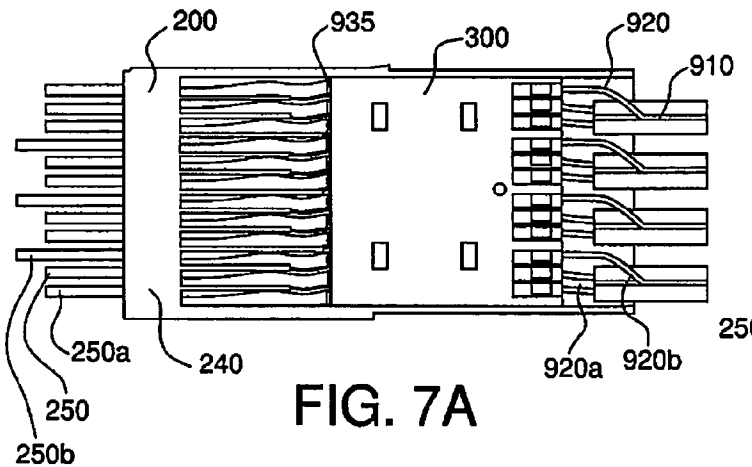
Figure 7C:
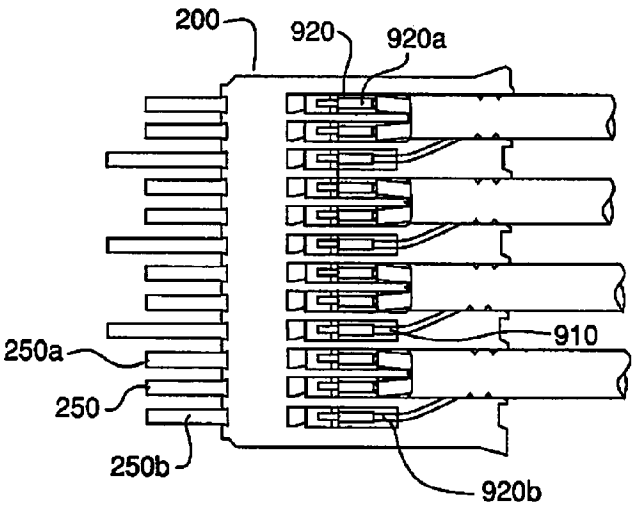

FIGS. 7A–7C depict example embodiments of terminal trays 200 and electrical connection of contacts 250 to cable wires 920 of cables 910. Signal contacts 250*a* may be connected to signal cable wires 920*a*, and ground contacts 250*b* may be connected to ground cable wires 920*b*. Signal cable wires 920*a* may form differential signal pairs or may be single-ended signal conductors.

FIGS. 7A and 7B depict electrical connection of contacts 250 to cable wires 920 through example embodiments of PCB 300 as depicted in FIGS. 4A and 4B, respectively. As shown in FIG. 7A, PCB 300 may be electrically connected to contacts 250 by physical pressure of contacts 250 on PCB 300. As shown in FIG. 7B, contacts 250 may be soldered to PCB 300 via solder slots 935. As shown in FIG. 7C, contacts 250 may be electrically connected directly to cable wires 920, i.e., without the use of a PCB. In such an embodiment, cable wires 920 may be soldered or otherwise electrically connected to contacts 250.

Figure 8:
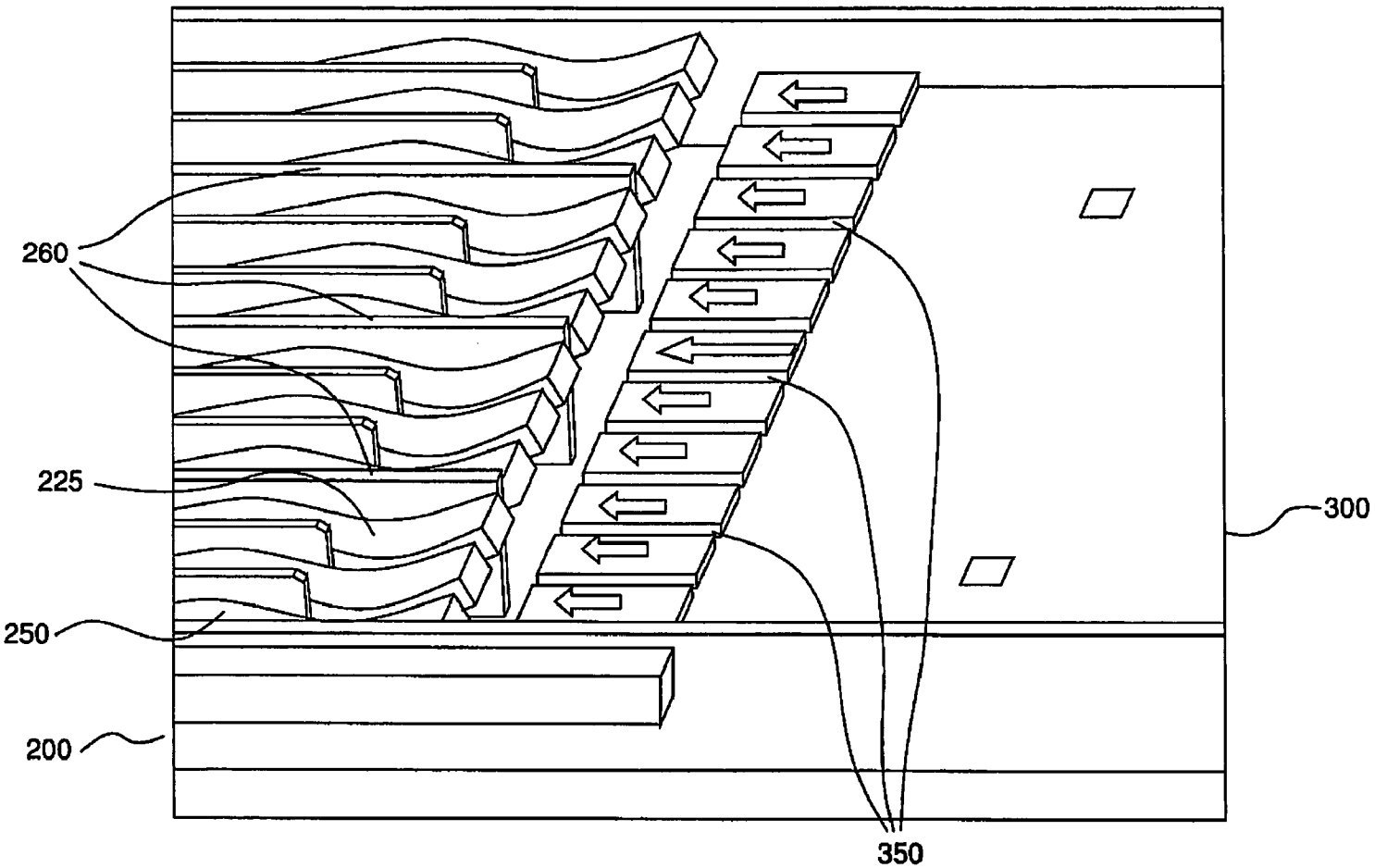
FIG. 8 is a partial view of an example embodiment of a terminal tray and printed circuit board in accordance with an aspect of the invention.

FIG. 8 is a partial view of an example embodiment of a terminal tray 200 and PCB 300 in accordance with an aspect of the invention. As shown, the respective ends 255 of each of contacts 250 may be bent into a "scoop" or "U" shape. As explained in connection with FIG. 4A, contacts 250 may be resilient and the "scoop" or "U" shape enables PCB 300 to slide underneath contacts 250 and enables contacts 250 to electrically connect to PCB 300 from the downward pressure exerted by contacts 250 on PCB 300. Also as explained, contacts 250 exert pressure on PCB 300 because contacts 250 are molded as part of terminal tray 200 and because contact tray bar 240 prevents contacts 250 in vicinity of bar 240 from moving as PCB 300 is slid underneath contacts 250. In this way, soldering contacts 250 to PCB 300 is not necessary.

FIG. 8 also depicts location keys 260 on terminal tray 200. Locations keys 260 align with assembly control slots 350 on PCB 300 to facilitate attaching PCB 300 in a proper location with a proper alignment to terminal tray 200.

Figure 9B:
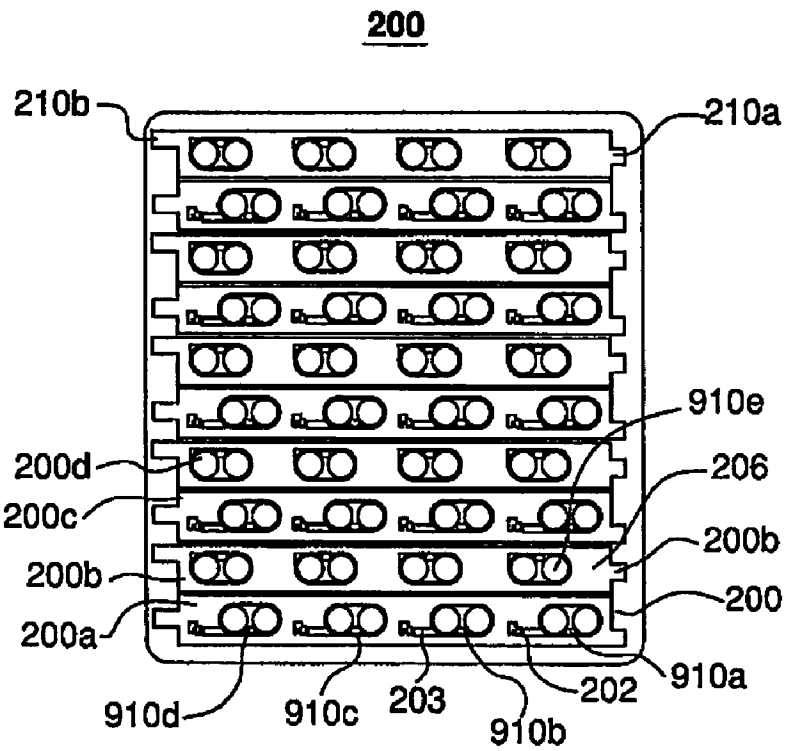
FIGS. 9A and 9B depict an example embodiment of a header connector in accordance with an aspect of the invention.
Figure 9A:
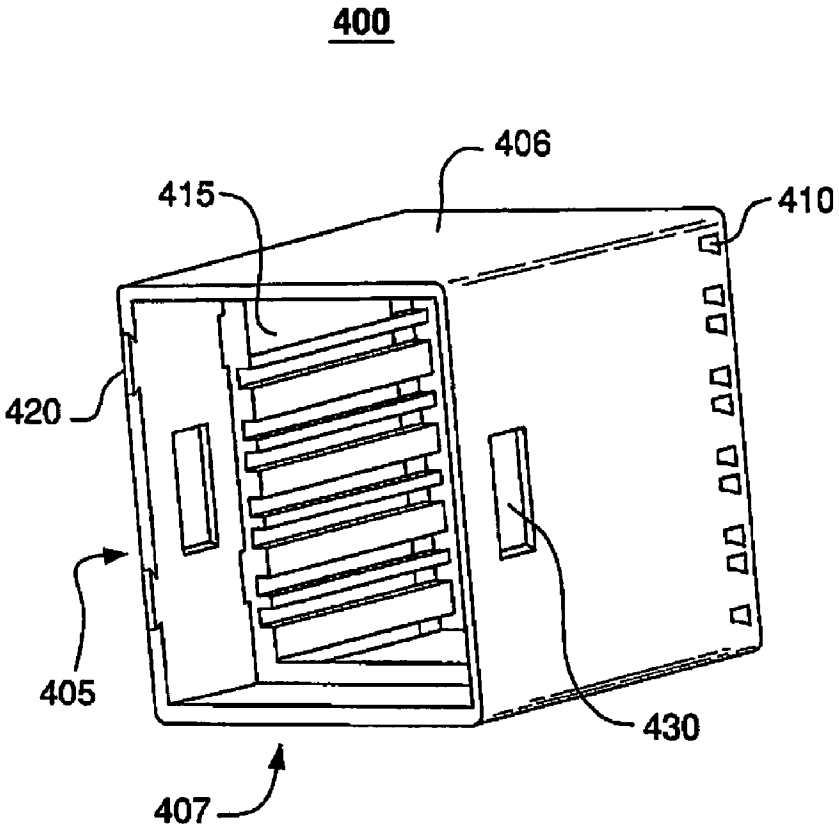

FIGS. 9A and 9B depict, respectively, an example embodiment of a header connector 400 and an end cross-sectional view of an example embodiment of terminal trays 200. Header connector 400, shown in FIG. 9A, may house any number of terminal trays 200. Header connector 200 may comprise a plurality of walls 405, 406, and 407, for example, that define an interior cavity. Walls 405, 406, and 407 may be molded as one continuous piece or otherwise connected to form a cube-shaped housing, for example.

One or more rails 415 may be molded as part of or otherwise connected to the inside of walls 405. Rails 415 support terminal trays 200 in connector header 400. Connector header 400 may include alignment slots 420 that align with alignment features 516 on receptacle 510 (see FIG. 1). Connector header 400 may also include a window 430 to enable a grounding contact (not shown) on connector body 850 to contact grounding band 515 of receptacle 510.

Connector header 400 may also include polarized latch windows 410 in walls 405. Polarized latch windows 410 may accept latches 210 of terminal trays 200. Additionally, polarized latch windows 410 may be located to ensure terminal trays 200 are inserted properly into connector housing 400.

FIG. 9A depicts polarized latch windows 410 that may be located to receive terminal trays 200 such that each terminal tray 200 is rotated 180° relative to adjacent terminal trays 200. This aspect is further described in connection with FIG. 9B.

FIG. 9B depicts an end, cross-sectional view of terminal trays 200 stacked adjacent each other. Bottom terminal tray 200*a* may be oriented such that cable 910*a* is located to the far right of terminal tray 200, and a space 202 is located to the left of cable 910*a*. Space 202 may align with a ground contact (not shown) located on the opposite end of terminal tray 200. To the left of space 202 may be cable 910*b*, with another space 203 to the left of cable 910*b*. Space 203 may align with another ground contact. This pattern of cables and spaces may repeat with cables 910*c* and 910*d*. Though four cables 910 per terminal tray 200 are shown in FIG. 9B, it should be understood that any number of cables may be used. Additionally, though cables 910 are shown configured for transmitting differential signals, it should be understood that some or all of cables 910 may be configured for transmission of single-ended signals as well.

It should also be understood that terminal tray 200*b* may be placed adjacent to terminal tray 200*a* such that the pattern of cables 910 and spaces between cables 910 is reversed from that of terminal tray 200*a*. For example terminal tray 200*b* may have space 206 to the far right with cable 910*e* placed to the left of space 206. This reversal of the pattern of terminal tray 200*a* occurs when terminal tray 200*b* is rotated 180° relative to terminal tray 200*a*. Terminal tray 200*c*, then, may have a similar orientation as terminal tray 200*a*, and terminal tray 200*d* may have a similar orientation as terminal tray 200*b*. This reversal of the orientation of adjacent terminal trays 200 may continue for all terminal trays located in connector header 400.

Reversal of orientation of successive terminal trays 200 may be desirable due to the orientation of ground and signal contacts in receptacle 510. That is, signal contacts 250*a* and ground contacts 250*b* may not align with the ground and signal contacts (not shown) of receptacle 510 if successive terminal trays are not rotated as described. It will be recognized that connector 200 may be adapted for other receptacle orientations as well.

Terminal trays 200 may include latches 210 to facilitate proper alignment of terminal trays 200 in connector header 400. For example, a terminal tray 200 may have a latch 210*a* located approximately in the middle on the right side of the terminal tray 200. Latch 210*b*, however, may be located toward the top of the left side of terminal tray 200. Polarized latch windows 410 of connector header 400 may be located such that latches 210 may be aligned with polarized latch windows 410 when terminal trays 200 are inserted with a correct orientation into connector header 400.

As shown, polarized latch windows 410 of connector header 400 are shown to receive terminal trays with the alignment described in connection with FIG. 9B. It should be understood, however, that polarized latch windows 410 of connector header 400 may be placed in different locations in order to accept terminal trays 200 in varying orientations. The combination of the locations of latches 210 and polarized latch windows 410 aid in the production of connector 100. Incorrect assembly may be avoided because terminal trays 200 may fit in connector header 400 only if correctly aligned.

Figure 10B:
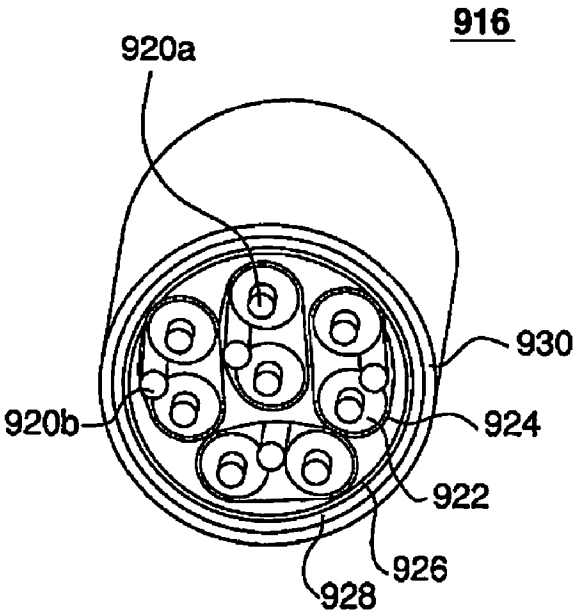
FIGS. 10A and 10B depict example embodiments of cables.
Figure 10A:
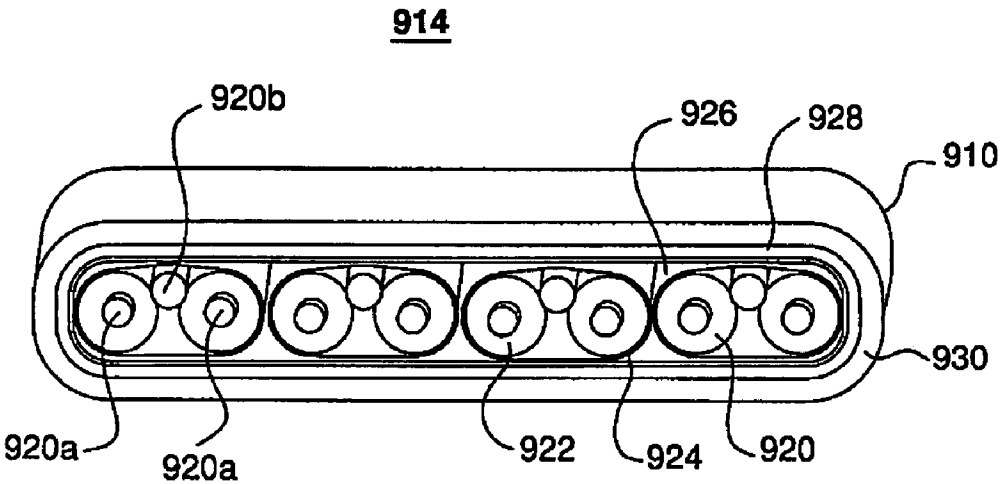

FIGS. 10A and 10B are perspective views of example embodiments of cables. FIG. 10A depicts a perspective view of an example embodiment of ribbon cable 914. FIG. 10B depicts a perspective view of round cable 916. Though connector 100 is depicted throughout as having a ribbon cable 914, it should be understood that a round cable 916 may be used instead. Cables 914 and 916 may have multiple signal cable wires 920*a* and associated ground cable wires 920*b*. Cable wires 920 may be silver plated copper or another suitable conductor. Signal cable wires 920*a* may be surrounded by dielectric material 922, such as flexible plastic, for example. For differential communications, signal cable wires 920*a* may be paired together and associated with a ground cable wire 920*b*. Signal cable wires 920*a* may be single-ended signal conductors.

Each pair of signal cable wires 920*a* and ground cable wire 920*b* may be surrounded by a shield 924. Shield 924 may help prevent electric fields associated with signal wire pairs from intermingling with such fields associated with adjacent signal cable wire pairs. Such intermingling may cause electrical interference, commonly referred to as cross talk, and thus degrade signal integrity. Shield 924 may be constructed of aluminum-poly or other suitable material. Cable wires 920 in cable 910 may be surrounded by additional shields 926 and 928. Shields 926, 928 may prevent cross talk between cables 910 in cable bundle 900. Foil shield 926 may be constructed of a thin layer of aluminum or other suitable material. Braid shield 928 may be constructed of a thicker layer of steel or other suitable material. Braid shield 928, though optional, may be more desirable for higher-speed communications. A cable jacket 930, which may be constructed of an insulator such as plastic, may overlay shield 928.

Figure 11A:
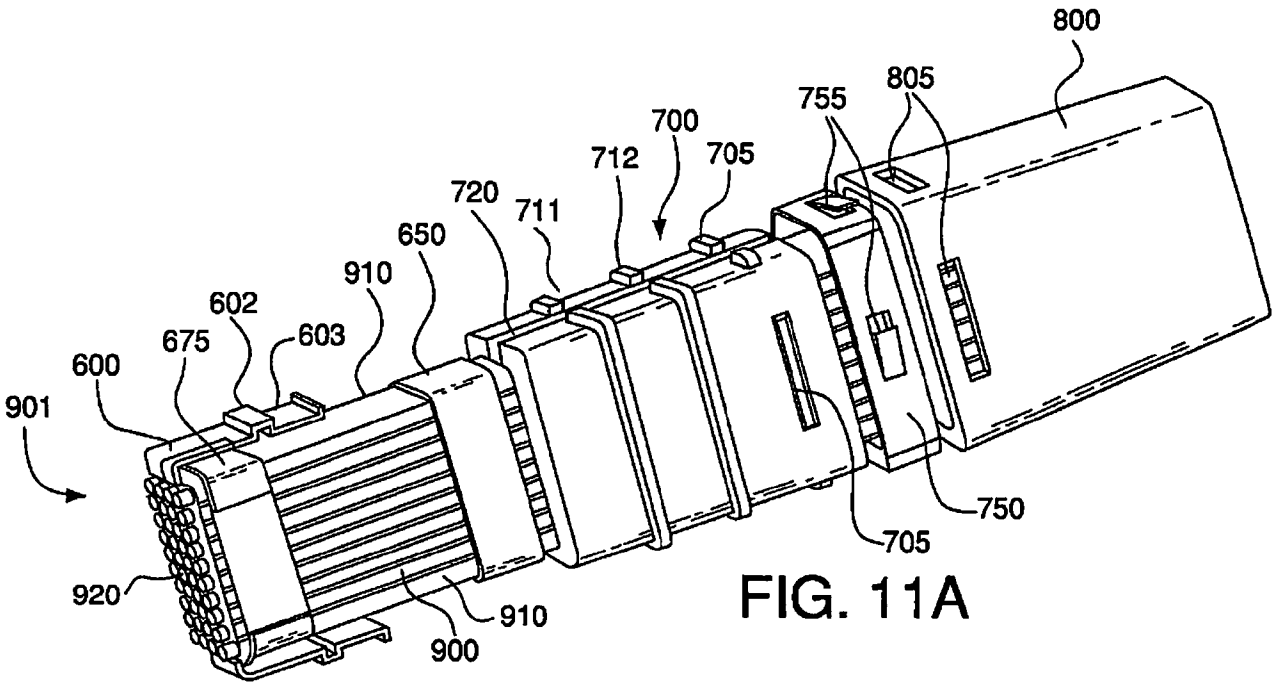
FIGS. 11A and 11B depict an example embodiment of a cable bundle and strain relief system in accordance with an aspect the invention.
Figure 11B:
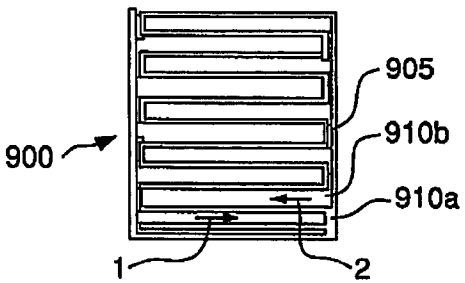

FIG. 11A depicts an exploded view of an example embodiment of a strain relief system 901 of cable bundle 900. FIG. 11B depicts a front cross sectional view of an example embodiment of cable bundle 900 in accordance with the invention. Connector 100 may have cable wires 920 located inside cables 910. Cables 910 may be held in cable bundle 900 in part by a strain relief band 650. Strain relief band 650 may hold cables 910 to prevent cables 910 within cable bundle 900 from movement relative to cable bundle 900 within connector body 850 when cable bundle 900 located outside of connector body 850 is moved.

FIG. 11B depicts a front cross sectional view of an example embodiment of cable bundle 900 and strain relief band 650. Individual cable wires 920 are not shown in FIG. 11B for clarity. Cable bundle 900 includes cables 910 placed adjacent to one another. Tape 905, with adhesive on two sides, commonly called double-sided tape, may be used to prevent movement of individual cables 910 relative to cable bundle 900. In one embodiment, tape 905 may be attached to one side of cable 910*a* and wrapped around cable 910*a* in the direction of arrow 1. A second cable 910*b* may be placed adjacent to tape 905 wrapped around cable 910*a*. Tape 905 may then be wrapped around cable 910*b* in direction of arrow 2, which is opposite direction of arrow 1. This process may be continued with successive cables 910. After tape 905 is wrapped around last cable of bundle 900, tape 905 may be wrapped around bundle 900. Because each cable may adhere to adjacent cables, and because tape may be wrapped around bundle 900, movement of individual cable wires in bundle 900 in the vicinity of strain relief band 650 may be minimized.

A crimp sleeve support 700 may further aid in preventing movement of individual cables 910 when placed around cable bundle 900 over strain relief band 650. Crimp sleeve 750 may be placed on crimp sleeve support 700 and may be deformed by a crimping tool (not shown) and compressed. Pressure created in deforming crimp sleeve 750 on crimp sleeve support 700 may cause compression of split housing 720 of crimp sleeve support 700. This compression may cause crimp sleeve support 700 to likewise compress cable bundle 900 and strain relief band 650, which may aid in preventing relative movement of individual cables 910. Crimp sleeve support 700 may have assembly latch 705 corresponding to polarized latch windows 805 of boot 800. When connector 100 is assembled, latch 705 and polarized latch windows 805 may mate and prevent boot 800 from slipping down cable 900. Boot 800 may protect cable bundle 900 from chafing or other damage in the immediate vicinity of connector body 850.

A braid 600 may be attached to cable bundle 900 to electrically connect cable braid shield 928 to crimp sleeve 750. Crimp sleeve 750 may have ground contacts 755 that electrically connect to connector body 850 when connector body 850 is attached to connector 100. Jackets 930 on exterior of and toward the end of cable bundle 920 may be cut away to expose braid shield 928 (see FIGS. 10A and 10B). Braid 600 may surround cable bundle 900 and be in contact with braid shield 928 of cables 910. Braid 600 may be held in place by a heat shrink tube 675. Heat shrink tube 675 may be made of thermal plastic such that, when in place and heated, heat shrink tube 675 contracts and holds braid 600 in contact with braid shields 928 of cables 910. Braid 600 may be placed on top of crimp sleeve support 700 such that notch 602 of braid 600 locates over rib 711 and plate 603 of braid 600 locates in between ribs 711 and 712 of crimp sleeve support 700. Crimp sleeve 750 may be attached to crimp sleeve support 700 in between ribs 711 and 712 and adjacent to plate 603 of braid 600. Braid 600 may be constructed of steel or any other suitable metal.

Figure 12:
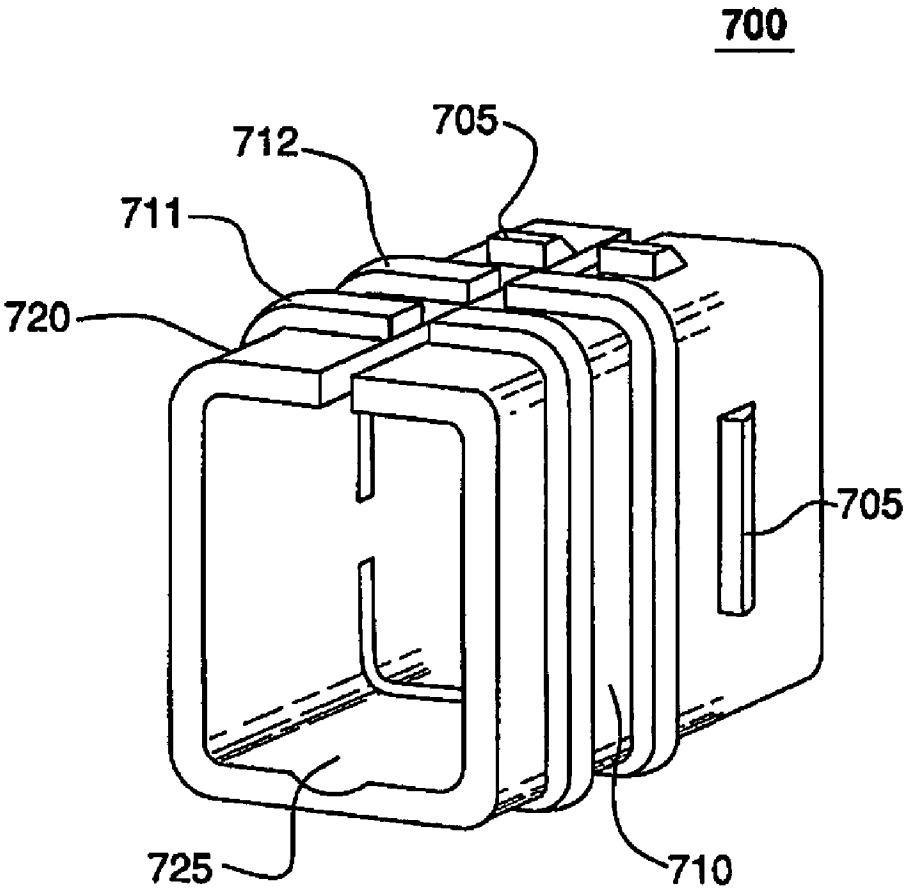
FIG. 12 depicts an example embodiment of a crimp sleeve support.

FIG. 12 is a perspective view of an example embodiment of a crimp sleeve support 700. Crimp sleeve support 700 assists in holding cable bundle 900 in connector body 850. Crimp sleeve support 700 may include a gripped or rough surface 710 and ribs 711, 712 to aid in preventing movement of crimp sleeve 750 relative to connector body 850. Crimp sleeve support 700 may include an interior crimp ring 725 that may compress strain relief band 650 when crimp ring 750 is deformed. Additionally, crimp sleeve support 700 may have a split housing 720 that allows crimp sleeve support 700 to be compressed when crimp ring 750 is deformed, and thereby may compress strain relief band 650 and cable bundle 900. This compression may aid in preventing movement of individual cables 910 located within connector body 850 relative to cable bundle 900 when cable bundle 900 located outside of connector body 850 is moved. Crimp sleeve support 700 may be constructed of a polymer substance or other suitable material.

Figure 13:
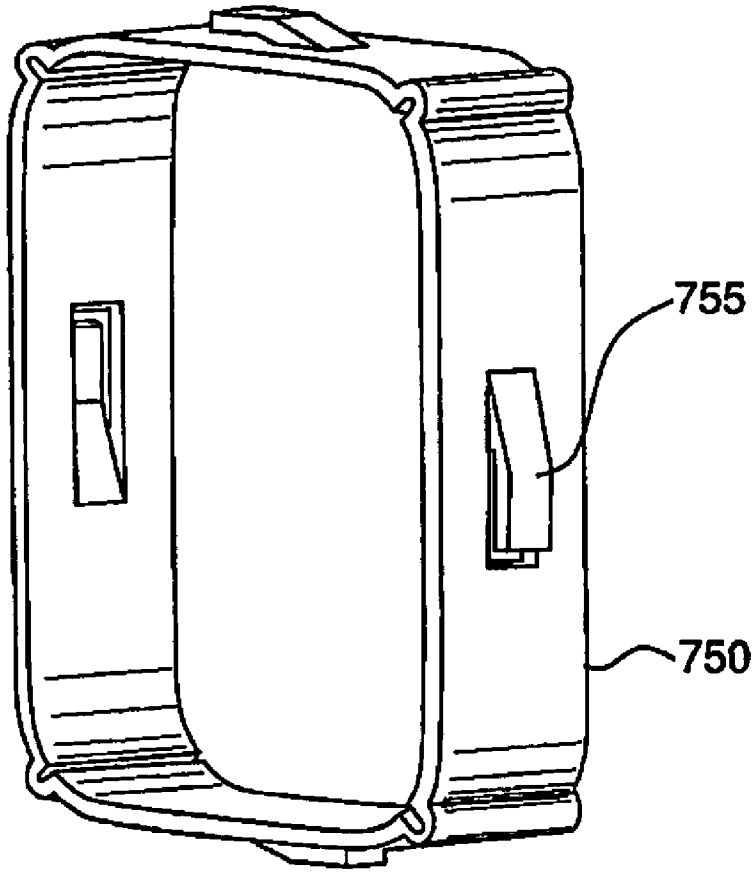
FIG. 13 depicts an example embodiment of a crimp ring.

FIG. 13 is a perspective view of an example embodiment of a crimp ring 750. Crimp ring 750 may aid in minimizing movement of cables 910 relative to cable bundle 900 and may maintain placement of shield 600. Crimp ring 750 may also electrically connect shield 600, and, therefore, shield braids 928 of cables 910, to connector body 850. Crimp ring 750 may be placed over crimp sleeve support and deformed, thereby compressing crimp sleeve support 700 and cable bundle 900 to prevent movement of individual cables 910 within connector body 850. Crimp ring 750 may include grounding contact 755 that may electrically connect to connector body 850. Crimp ring 750 may be constructed of sheet metal or other suitable material.

Figure 14:
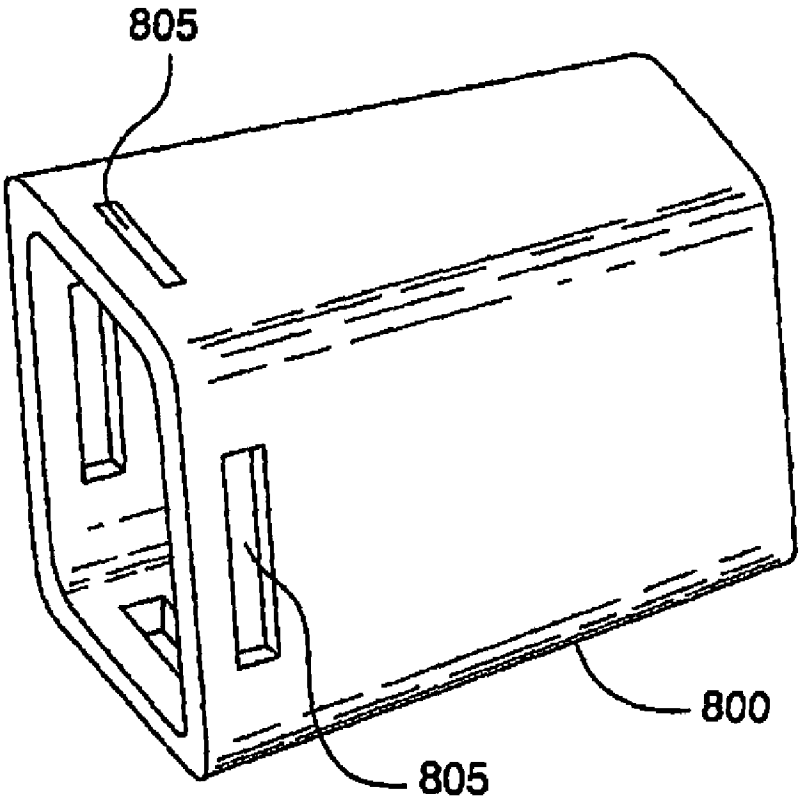
FIG. 14 depicts an example embodiment of a boot.

FIG. 14 is a perspective view of an example embodiment of a boot 800. Boot 800 may protect cable bundle 900 from chafing or other damage in the immediate vicinity of connector body 850. Boot 800 may have latch window 805 that may receive latch 705 of crimp sleeve support 700, thereby attaching boot 800 to connector 100. Boot 800 may be constructed of rubber or other suitable material.

Figure 15:
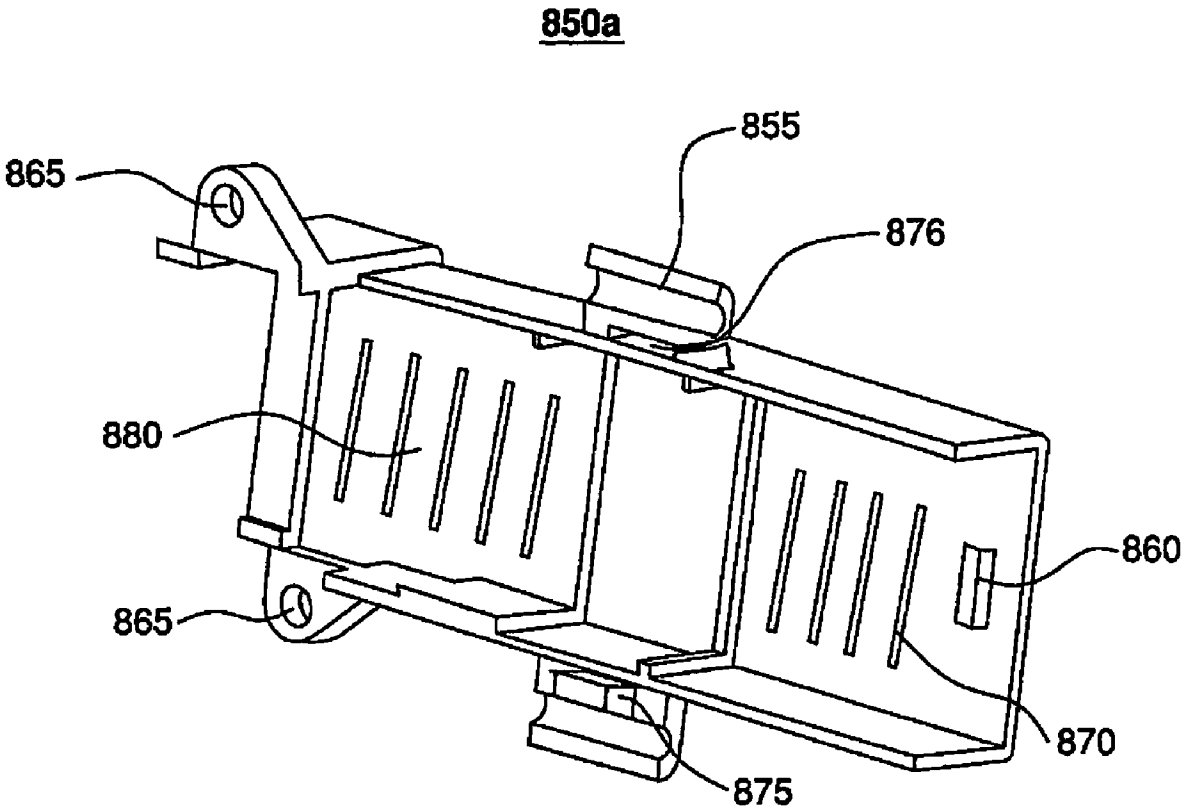
FIG. 15 depicts an example embodiment of a connector body in accordance with an aspect of the invention.

FIG. 15 is a perspective view of an example embodiment of a connector body half 850*a* in accordance with the invention. Connector body 850 may house strain relief system 901 and may also enable attachment of connector 100 to a computer or other device. Connector body may also facilitate connection of braid shield 928—through intervening connections by crimp sleeve 750 and braid 600—of cables 910 with electrical ground of a computer or other device. Connector body 850 may be constructed such that two identical connector body halves 850*a* may be connected to form a complete body 850 surrounding connector 100. Connector body 850 may include orientation control features or ribs 870 to press against and aid in preventing movement of connector header 400 and strain relief system 901 relative to connector 100. Connector body 850 may include a grounding contact 860 to connect ground band 515 of receptacle 510 (see FIG. 1) when connector 100 is connected to a computer or other device. Connector body 850 may have mount screw holder 855 for receiving an alignment screw that may mount connector 100 to a computer or other device while aligning alignment screw with screw post 825 (see FIG. 1).

Each connector body half 850*a* may have an assembly locking blade 875 and assembly locking slot 876 that may enable connector body half 850*a* to be attached to another connector body half. Assembly locking blade 875 may be "L" shaped and may interlock with a corresponding assembly locking slot 876 after placing two connector body halves together and sliding the assembly locking blades 875 to lock into assembly locking slots 876. Connector body half 850*a* may have assembly screw feature 865 to receive screws (not shown) and connect one connector body half to a second connector body half. Connector body half 850*a* may also include a housing 880 to restrain crimp sleeve support 700 from movement relative of connector body 850. Connector body half 850*a* may be constructed of die cast metal or similar material.

It should be understood that even though numerous characteristics and advantages of the present invention have been set forth in the foregoing description, the disclosure is illustrative only and changes may be made in detail within the principles of the invention to the full extent indicated by the broad general meaning of the terms in which appended claims are expressed. For example, though a connector according to the invention has been described herein in relation to connecting a computer or device to an external component, the connector may also be used to connect components internal to a computer. Additionally, though a PCB has been described herein as being an equalizer card for equalizing signal propagation times between conductors within the connector, it should be understood that the PCB may be any type of device for improving the characteristics of the connector or connection. Also contacts have been described as being bent in a "scoop" or "U" shape by way of example only. A contact may be bent in other ways as well.

What is claimed is:

1. A terminal tray for an electrical connector, the terminal tray comprising:

a tray body made of an electrically insulating material; and an electrically conductive contact, said contact having a connector mating end that extends beyond an end of the tray body and a board receiving end opposite the connector mating end, wherein the board receiving end of the contact is adapted to receive a printed circuit board and to exert sufficient pressure on the printed circuit board to retain the printed circuit board between the contact and the tray body and wherein the terminal tray has a location key extending therefrom, said location key being adapted to align with a complementary slot in the printed circuit board.

2. The terminal tray of claim 1, wherein the contact extends at least partially through the tray body.

3. The terminal tray of claim 1, wherein the tray body is overmolded onto the contact.

4. The terminal tray of claim 1, wherein the tray body includes a tray bar that prevents the contact from moving while the printed circuit board is being slid between the contact and the tray body.

5. The terminal tray of claim 1, wherein the tray body includes a press-fit pin extending therefrom, said press-fit pin being adapted to extend through a complementary hole in the printed circuit board.

6. The terminal tray of claim 1, wherein the tray body includes a latch extending therefrom, said latch being adapted to engage a complementary window in a connector header that is adapted to receive said terminal tray in an interior thereof.

7. The terminal tray of claim 1, wherein the terminal tray has a rib extending therefrom, said rib being adapted to stop the printed circuit board from moving in a direction in which the circuit board may be slid between the contact and the tray body.

8. The terminal tray of claim 1, wherein the contact is resilient and is adapted to exert a spring force on the printed circuit board.

9. The terminal tray of claim 1, wherein the board receiving end of the contact is generally curved.

10. An electrical connector, comprising:

a connector header having a housing that defines an interior thereof, said housing further defining a plurality of latch receiving windows; and first and second terminal trays received within the interior of the connector header, each of the first and second terminal trays comprising a tray body made of an electrically insulating material and having a latch extending therefrom, and an electrically conductive contact having a connector mating end that extends beyond an end of the tray body;

wherein each latch receiving window is disposed such that the first terminal tray is received in the connector header in a first orientation and the second terminal tray is received in the connector header adjacent to the first terminal tray only in a second orientation, the first and second orientations being different.

11. The electrical connector of claim 10, wherein the latch extends from a face of the tray body, the face having a first end and a second end, the latch disposed off-center between the ends of the face.

12. The electrical connector of claim 10, wherein each latch receiving window is disposed to receive a latch of a tray body only after the second terminal tray is rotated 180° with respect to the first terminal tray.

13. The electrical connector of claim 10, wherein the shape of the terminal tray body of the first terminal tray is the same as the shape of the terminal tray body of the second terminal tray.

14. The electrical connector of claim 10, wherein said housing includes a tray receiving groove that extends from each latch receiving window of the plurality of latch receiving windows along an interior wall of the housing.

15. A terminal tray for an electrical connector, the terminal tray comprising:

a tray body made of an electrically insulating material; and an electrically conductive contact, said contact having a connector mating end that extends beyond an end of the tray body and a board receiving end opposite the connector mating end, wherein the board receiving end of the contact is adapted to receive a printed circuit board and to exert sufficient pressure on the printed circuit board to retain the printed circuit board between the contact and the tray body and wherein the terminal tray has a rib extending therefrom, said rib being adapted to stop the printed circuit board from moving in a direction in which the circuit board may be slid between the contact and the tray body.

16. The terminal tray of claim 15, wherein the contact extends at least partially through the tray body.

17. The terminal tray of claim 15, wherein the tray body is overmolded onto the contact.

18. The terminal tray of claim 15, wherein the tray body includes a tray bar that prevents the contact from moving while the printed circuit board is being slid between the contact and the tray body.

19. The terminal tray of claim 15, wherein the tray body includes a press-fit pin extending therefrom, said press-fit pin being adapted to extend through a complementary hole in the printed circuit board.

20. The terminal tray of claim 15, wherein the tray body includes a latch extending therefrom, said latch being adapted to engage a complementary window in a connector header that is adapted to receive said terminal tray in an interior thereof.

21. The terminal tray of claim 15, wherein the contact is resilient and is adapted to exert a spring force on the printed circuit board.

22. The terminal tray of claim 15, wherein the board receiving end of the contact is generally curved.

* * * * *